US007063464B2

(12) United States Patent
Weber et al.

(10) Patent No.: US 7,063,464 B2
(45) Date of Patent: Jun. 20, 2006

(54) RECIPROCATING PISTON MECHANISM

(75) Inventors: Georg Weber, Egelsbach (DE); Peter Barth, Bielefeld (DE)

(73) Assignee: LuK Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 10/631,500

(22) Filed: Jul. 30, 2003

(65) Prior Publication Data

US 2004/0094031 A1 May 20, 2004

Related U.S. Application Data

(63) Continuation of application No. PCT/DE01/03770, filed on Sep. 26, 2001.

(30) Foreign Application Priority Data

Feb. 2, 2001 (DE) ..... 101 04 654

(51) Int. Cl.
*F16C 27/00* (2006.01)
*F16C 17/00* (2006.01)
*F04B 19/00* (2006.01)

(52) U.S. Cl. ..... 384/215; 384/275; 384/286; 384/535; 417/269

(58) Field of Classification Search ..... 384/215, 384/275, 276, 286, 287, 289, 290, 535, 581; 184/6.17; 417/269
See application file for complete search history.

(56) References Cited

U.S. PATENT DOCUMENTS

| | | | | |
|---|---|---|---|---|
| 2,929,551 | A | 3/1960 | Heidorn | |
| 3,552,886 | A | 1/1971 | Olson | |
| 3,712,759 | A * | 1/1973 | Olson, Jr. | 417/269 |
| 3,945,765 | A * | 3/1976 | Toyoda et al. | 417/269 |
| 4,321,019 | A * | 3/1982 | Degawa et al. | 417/269 |
| 4,431,378 | A * | 2/1984 | Hattori et al. | 417/269 |
| 4,444,549 | A | 4/1984 | Takahashi et al. | |
| 5,137,431 | A * | 8/1992 | Kiyoshi et al. | 417/269 |
| 5,370,505 | A * | 12/1994 | Takenaka et al. | 417/269 |
| 5,393,204 | A * | 2/1995 | Kawahara | 417/269 |
| 5,483,867 | A * | 1/1996 | Ikeda et al. | 92/71 |
| 5,501,579 | A * | 3/1996 | Kimura et al. | 417/269 |
| 5,562,182 | A * | 10/1996 | Kayukawa et al. | 184/6.17 |

FOREIGN PATENT DOCUMENTS

| | | |
|---|---|---|
| DE | 42 11 695 A1 | 10/1992 |
| EP | 1 065 375 A2 | 1/2001 |

* cited by examiner

*Primary Examiner*—Richard W. Ridley
*Assistant Examiner*—Colby Hansen
(74) *Attorney, Agent, or Firm*—Darby & Darby

(57) ABSTRACT

A reciprocating piston mechanism for an air-conditioning compressor in a motor vehicle has a housing, a rotary driven shaft, a shaft seal assembly with a gliding ring seal, at least one radial shaft bearing, and at least one axial shaft bearing. At least the radial shaft bearing is seated in a bearing sleeve that is connected to the compressor housing and projects into an interior space of the housing

8 Claims, 2 Drawing Sheets

RECIPROCATING PISTON MECHANISM

CROSS-REFERENCE TO RELATED APPLICATION

This application is a continuation of International patent application Ser. No. PCT/DE01/03770, filed Sep. 26, 2001, published in German, which is hereby incorporated by reference in its entirety.

BACKGROUND OF THE INVENTION

The invention relates to a reciprocating piston mechanism such as an air-conditioning compressor for motor vehicles, which has a housing, a rotary driven shaft, a shaft-sealing device, in particular a gliding ring seal, at least one radial shaft bearing, in particular a radial roller bearing, and at least one axial shaft bearing, in particular an axial roller bearing. Reciprocating piston mechanisms of this type, which are used for air-conditioning systems in motor vehicles, belong to the known state of the art. Inside the housing or in components of the housing there are bearings for the rotary driven shaft which drives a mechanism that is arranged within the housing and serves to compress the refrigerant. Because the swash-plate, tilting plate, or wobble-plate device in a piston-drive mechanism of this type exerts both radial and axial forces on the shaft, the rotating shaft is subjected to a revolving bending deformation that is due primarily to the radial force components. As a consequence, the radial bearing is subjected to stresses and deformations which can cause increased wear as well as power losses due to increased friction, especially if the radial bearing is designed to be rigid relative to bending deformations so that it cannot adjust to the bending of the driving shaft, which results in forced internal reactions and increased friction.

Also known in the art are compressors that contain a gliding ring seal, which must be supplied with an appropriate lubricant. Depending on the design of the compressor housing and the bearings, the lubrication of the gliding ring seal requires appropriate bore channels to serve as conduits for the lubricant inside the housing. In terms of manufacturing technology, bore channels of this type are difficult to produce in a housing.

OBJECT AND SUMMARY OF THE INVENTION

The invention therefore has the objective to create a reciprocating piston mechanism, such as an air-conditioning compressor for motor vehicles, that is free of the aforementioned drawbacks.

The invention proposes a solution that meets this objective in a a reciprocating piston mechanism such as an air-conditioning compressor for motor vehicles, which has a housing, a rotary driven shaft, a shaft-sealing device, in particular a gliding ring seal, at least one radial shaft bearing, in particular a radial roller bearing, and at least one axial shaft bearing, in particular an axial roller bearing. According to the invention, at least the radial shaft bearing is held in a bearing sleeve that is connected to the housing and protrudes into the interior of the housing. In a preferred embodiment of the inventive reciprocating piston mechanism, the bearing sleeve can elastically bend and thereby cushion the radial shaft bearing in a radial direction. Thus, the bearing sleeve provides a combination of damping properties and bending stiffness that will favorably affect the operating lifespan of the bearing.

In a further preferred embodiment of the inventive reciprocating piston mechanism, the end of the bearing sleeve that faces away from the radial bearing has a smaller diameter and passes through a collar-shaped opening in the housing. The reduced-diameter end of the sleeve that extends out of the housing enters into a ring-shaped bearing mount for a drive pulley assembly. As an additional benefit of the invention this allows the bearing sleeve to be used as a weld pool backup for the welding of the housing and the ring-shaped bearing mount.

According to a further embodiment of the invention, the bearing sleeve can hold the axial shaft bearing. In performing this function, the bearing sleeve is distinguished by its strength and rigidity to withstand the axial forces acting on the bearing.

A further embodiment of the reciprocating piston mechanism according to the invention is characterized by lateral openings in the bearing sleeve between the sleeve section that is connected to the housing and the section that holds the radial shaft bearing. These openings serve as passages for the lubricant, and they also allow the sleeve to be designed with a specific radial stiffness through appropriate selection of the cross-sectional area of the openings of the contour shape of the sleeve. In one embodiment pursuant to the invention, the lateral openings are in the area of a shaft seal device, in particular a glide ring seal, that is arranged at least partially in the bearing sleeve.

A further embodiment is distinguished by a stepped down and/or tapered shape of the outside diameter of the bearing sleeve, in which the diameter decreases towards the end of the bearing sleeve that is nearest the housing and protrudes through the housing. As a result, lubricant that has been spun off inside the housing and has run down off the housing wall is fed to the lateral openings for cooling and lubricating the glide ring seal. The lubricant that is fed to the glide ring seal is preferably removed by way of the radial bearing.

BRIEF DESCRIPTION OF THE DRAWINGS

Several embodiments of the invention will be described below with reference to the drawings, wherein.

DETAILED DESCRIPTION OF PREFERRED EMBODIMENTS

Figure 1:
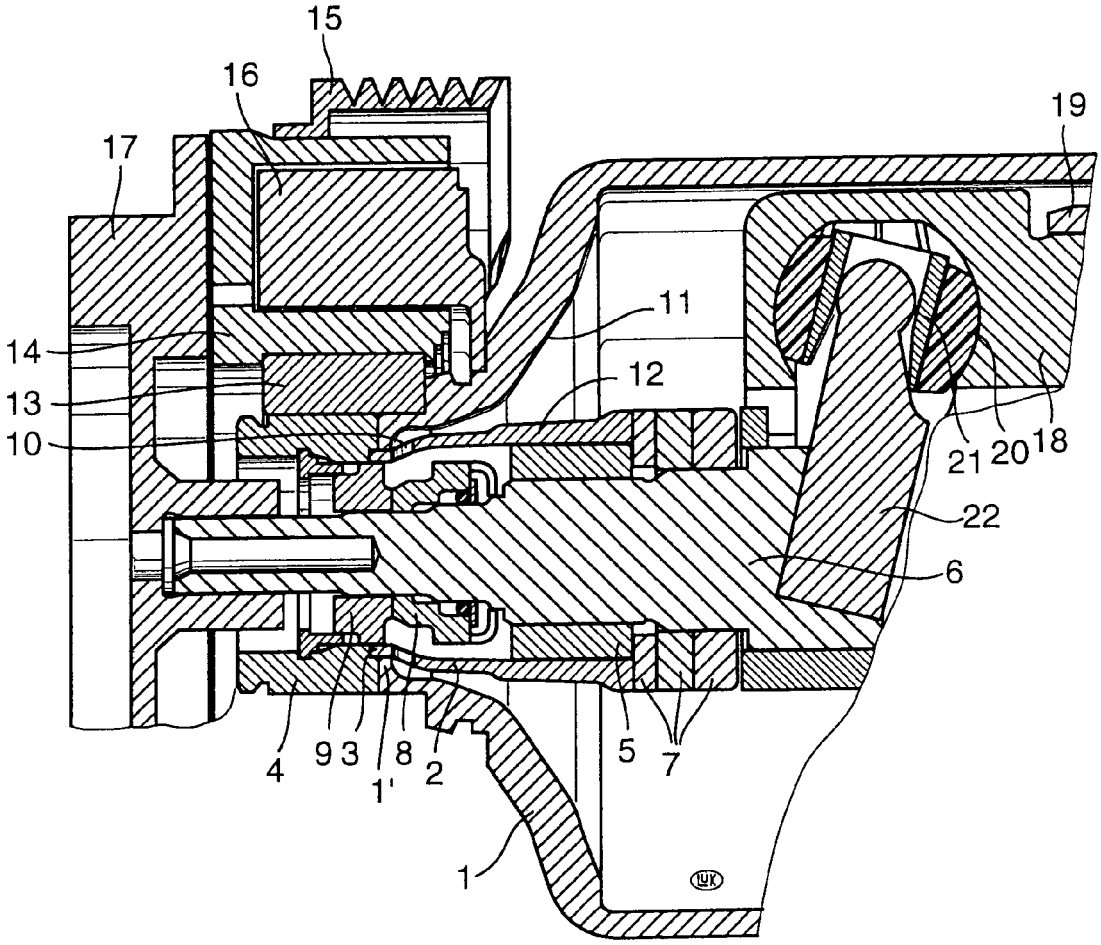
FIG. 1 shows a cross-section of the anterior portion of an air-conditioning compressor with a pulley.

FIG. 1 illustrates a bearing sleeve 2 arranged in a housing 1 of an air-conditioning compressor, wherein the reduced-diameter anterior end 3 of the bearing sleeve protrudes through a collar-shaped opening 1' in the housing, and the portion of the reduced-diameter end 3 that extends beyond the housing enters into a ring-shaped bearing mount 4 for a drive pulley assembly. Positioned inside the bearing sleeve 2 is a radial roller bearing 5 which, in turn, supports a driving shaft 6. In addition, on the end of the bearing sleeve 2 that protrudes into the housing, an axial bearing 7 for the driving shaft 6 is shown, which in this case is made up of three parts comprising two bearing shells and the actual roller elements. The construction of this type of bearing is known and will therefore not be covered in more detail. Further, a gliding ring seal is in part positioned on the driving shaft 6 inside the bearing sleeve 2. The seal consists of a component 8 that rotates together with the shaft 6 and of a non-rotating component 9 that is seated in the bearing mount 4 for the drive pulley assembly. Gliding ring seals of this type are likewise known and their function will therefore not be explained in further detail. It is an important feature of the invention that the bearing sleeve 2 has lateral passage openings 10 in the area of the gliding ring seal 8, 9, which allow lubricant that has dripped off the housing wall area 11 and has been collected by the sleeve 2 to be carried to the gliding ring seal, particularly to the interstice between the rotating component 8 and the stationary component 9. The flow of lubricant to the gliding seal ring is enhanced by the tapered or stepped-shaped outside contour 12 of the bearing sleeve 2, which directs the lubricant toward the openings 10. As a further important feature of the invention, which will be evident from FIG. 1, the portion 3 of the bearing sleeve 2 that extends through the end of the housing and protrudes into the bearing mount 4 for the drive pulley assembly acts as a mounting post for the bearing mount 4 and thus can also serve as a weld pool backup if the housing 1 is to be welded to the bearing mount 4. To further explain the function of the bearing mount 4, the latter carries a roller bearing 13 supporting a drive pulley assembly 14 which includes a pulley 15 and a clutch 16 for coupling the drive pulley assembly to a rotary drive plate 17. When the clutch 16 is engaged, the rotation of the pulley 15 is transferred to the driving shaft 6. Clutch arrangements of this type are part of the known state of the art and will therefore not be discussed further. Aspects that are essential to the invention are the functions of the bearing sleeve 2, which can serve both as a connector and if necessary as the weld pool backup for the housing 1 and the bearing mount 4, while it simultaneously functions as a mounting support for the radial bearing 5 and the axial bearing 7 and as a lubricant supply device for the gliding ring seal components 8 and 9. FIG. 1 further illustrates sections of the compressor drive mechanism, which consists of a plurality of pistons 18 that run in cylinder bushings 19. The shaft 6 drives the reciprocating movement of the pistons 18 by way of a driver arm 22 driving a wobble plate 20 that is tilted at an oblique angle and engages the pistons through glide shoes 21 in the shape of spherical segments. The rotary motion of the tilted wobble plate 20 gliding through the glide shoes 21 generates a back and forth movement of the pistons 18 inside the cylinder chambers 19, which results in the intake and compression of refrigerant in the cylinder chambers 19. The forces exerted by the wobble plate 20 on the pistons 18, and the reactive forces on the pistons 18 generated by the build-up of pressure in the cylinder and acting back on the shaft 6 through the wobble plate 20 and the driver arm 22 lead, among other force components, to radial forces that cause a revolving bend in the shaft 6, which causes a reaction in the radial bearing 5. However, because the bearing sleeve 2 is solidly connected only to the anterior portion of the housing neck 1', a limited amount of bending is possible in the portion of the bearing sleeve 2 that projects freely into the housing, with the bending flexibility being further enhanced by the openings 10. As a result, the bearing sleeve can elastically absorb the radial forces and torques acting on the bearing 5, and an optimal cushioning and damping of the reactive forces in the bearing can be achieved by appropriately dimensioning the cross-sectional area of the openings 10 and the wall strength of the bearing sleeve.

Figure 2:
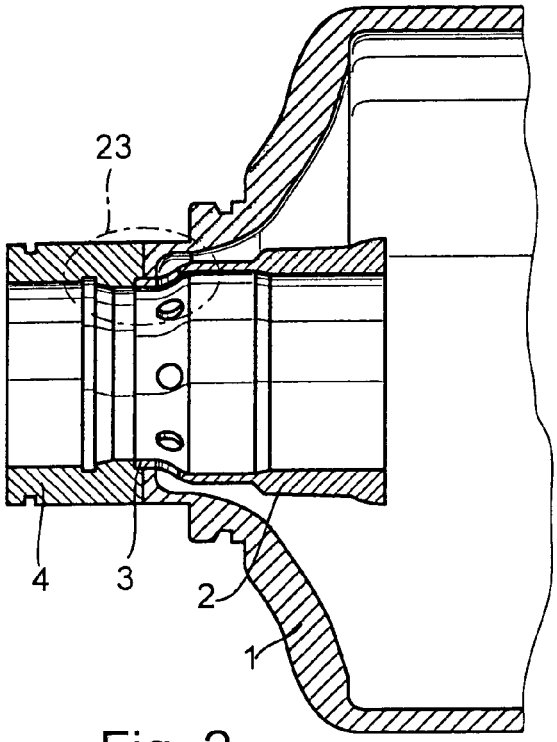
FIG. 2 shows the cross-section of a portion of the housing with the sleeve and the ring-shaped bearing mount for the drive pulley assembly.

FIG. 2 gives a more detailed view of only the housing 1, the bearing sleeve 2 with its ring-shaped collar 3, and the ring-shaped bearing mount 4. The circled detail area 23 illustrates how the anterior collar 3 of the bearing sleeve 2 centers the bearing mount 4 relative to the housing section 1, so that it can also serve as a weld pool backup for the welding of the bearing mount 4 to the housing 1. This makes it possible to manufacture the bearing mount 4 separately and to design it with a heavier wall thickness so that it can withstand the bearing forces, while the remainder of the housing can be made of a thinner-walled material, such as sheet metal, or as a deep-drawn component.

Figure 3:
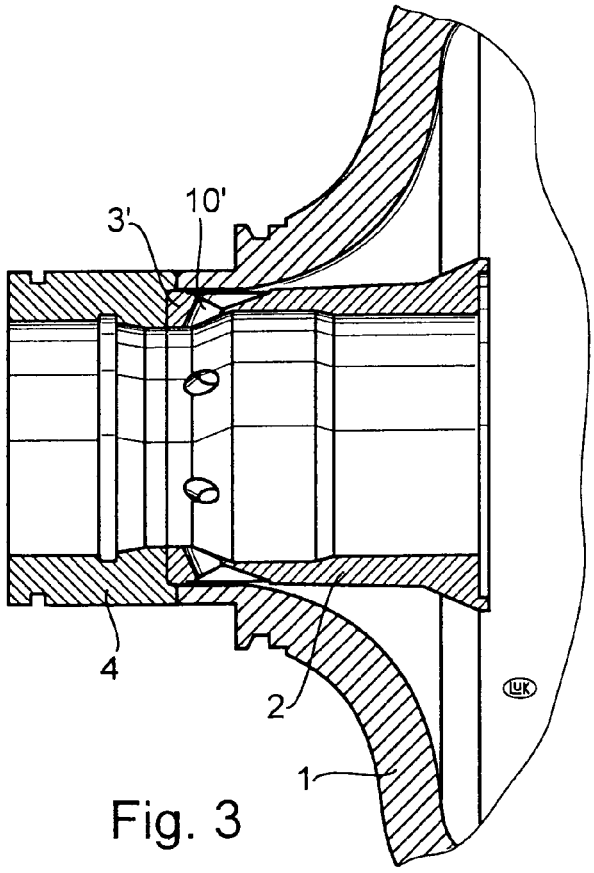
FIG. 3 shows a cross-section analogous to FIG. 2, but with a different design for the bearing sleeve.

FIG. 3 shows a different construction for the bearing sleeve, wherein the anterior portion 3' has a greater wall thickness than the sleeve of FIG. 2, so that the material cross-section, which connects the bearing mount 4 and the compressor housing 1, is thicker-walled, and thus is built to be stronger in the area of support or of the weld pool backup. Farther along the bearing sleeve 2, however, the somewhat different shape of the openings 10' provides flexibility in the connection between the portion of the bearing sleeve 2 that holds the radial bearing 5 (see FIG. 1) and the anterior portion 3'. Thus, by making appropriate design choices for the sleeve diameter, the sleeve shape, the wall thickness, and the passage openings 10', the bearing sleeve 2 can be given damping and stiffness properties that will improve the lifespan of the bearing. In addition, the shape of the bearing sleeve 2 can be modified independently of the shape of the housing 1 so that even an axial bearing 7 (as shown in FIG. 1) can be supported by the bearing sleeve 2. If the passage openings 10 or 10' are placed in the area of the gliding ring seal interstice that is to be lubricated, the bearing sleeve 2 can perform the additional function of supplying lubricant (which is contained as an additive in the refrigerant) directly to the rotating seal ring, whereby the ability of the bearing sleeve to collect lubricant is enhanced by the outside contour shape of the bearing sleeve portion that projects into the interior of the housing.

Without further analysis, the foregoing will so fully reveal the essence of the present invention that others can, by applying current knowledge, readily adapt it for various applications without omitting essential generic or specific features that set the present invention apart from the prior state of the art. Therefore, such adaptations should be understood to fall within the scope and range of equivalence of the appended claims.

What is claimed is:

1. A reciprocating piston mechanism for an air-conditioning compressor in a motor vehicle, comprising a housing, a rotary driven shaft, a shaft seal assembly including a gliding ring seal, at least one radial shaft bearing, at least one axial shaft bearing, and a bearing sleeve connected to the housing and extending into an interior space of said housing, wherein at least the radial shaft bearing is seated in said bearing sleeve, wherein the bearing sleeve has a first end portion holding the radial shaft bearing and a second, opposite end portion, wherein said second end portion has a smaller diameter than the first end portion and said second end portion passes through a collar-shaped opening in the housing, and wherein the second end portion extends further beyond the collar-shaped opening and enters into a ring-shaped bearing mount for a drive pulley assembly, wherein the ring-shaped bearing mount is a separate component relative to the housing.

2. The mechanism of claim 1, wherein the bearing sleeve is configured with a degree of stiffness to provide elastic cushioning and damping of the radial shaft bearing in a radial direction.

3. The mechanism of claim 1, wherein the bearing sleeve is configured for use as a weld pool backup for welding the bearing mount to the housing.

4. The mechanism of claim 1, wherein further the axial shaft bearing is seated in the bearing sleeve, and wherein the bearing sleeve is configured with a requisite strength and rigidity to withstand axial forces acting on the axial shaft bearing.

5. The mechanism of claim 1, wherein the bearing sleeve has lateral openings between the first end portion and the second end portion, wherein said lateral openings function as lubricant passages, and wherein said lateral openings further provide a degree of design freedom to select a cross-sectional size and shape of the lateral openings in combination with a contour shape of the bearing sleeve and thereby achieve an intended amount of stiffness of the bearing sleeve for absorbing radial forces on the radial shaft bearing.

6. The mechanism of claim 5, wherein the gliding ring seal is contained at least partially within the bearing sleeve and the lateral openings are placed near the gliding ring seal.

7. The mechanism of claim 1, wherein the bearing sleeve has one of a tapered contour and a stepped contour with a bearing sleeve diameter that decreases towards said second end portion so that as a result, lubricant that has been spun off inside the housing and has run along a housing wall flows through the lateral openings to the glide ring seal for cooling and lubrication of the glide ring seal.

8. The mechanism of claim 7, wherein the lubricant that flows to the glide ring seal is carried away through the radial bearing.

* * * * *